United States Patent [19]

VanBenthuysen

[11] 4,334,352

[45] Jun. 15, 1982

[54] METHOD OF MAKING A VARIABLE RESISTANCE CONTROL

[75] Inventor: John D. VanBenthuysen, Elkhart, Ind.

[73] Assignee: CTS Corporation, Elkhart, Ind.

[21] Appl. No.: 94,846

[22] Filed: Nov. 16, 1979

Related U.S. Application Data

[62] Division of Ser. No. 899,116, Apr. 24, 1978, Pat. No. 4,210,896.

[51] Int. Cl.[3] ..... H01C 17/06

[52] U.S. Cl. ..... 29/620; 29/610 R

[58] Field of Search ..... 29/621, 622, 610 R, 29/884, 885, 610, 620; 264/272.11, 272.18

[56] References Cited

U.S. PATENT DOCUMENTS

| | | | |
|---|---|---|---|
| 2,269,136 | 1/1942 | Tellkamp | 29/621 X |
| 2,811,621 | 10/1957 | Mucher et al. | 29/621 X |
| 3,132,196 | 5/1964 | Veatch, Jr. | 264/272.11 |
| 3,375,478 | 3/1968 | Van Benthuysen et al. | 338/174 |
| 3,561,113 | 2/1971 | Burke | 29/621 |
| 3,869,789 | 3/1975 | Yungblut et al. | 29/610 R |
| 4,041,439 | 8/1977 | Steddom et al. | 29/621 |
| 4,052,786 | 10/1977 | Hufford et al. | 29/610 R |
| 4,070,752 | 1/1978 | Robinson | 29/622 X |

*Primary Examiner*—Francis S. Husar
*Assistant Examiner*—C. J. Arbes
*Attorney, Agent, or Firm*—Larry J. Palguta; John A. Young

[57] ABSTRACT

A variable resistance control includes a metallic structure plate that functions as a heat sink and that provides both a collector and terminals, a body that is molded onto the structure plate, a resistance element that is deposited onto the body and onto portions of the terminals, a contactor, and a driver. In one embodiment, additional miniaturization is made possible by bending a tab portion of the structure plate between two of the terminals to form a stop lug for limiting rotational movement of the driver.

7 Claims, 5 Drawing Figures

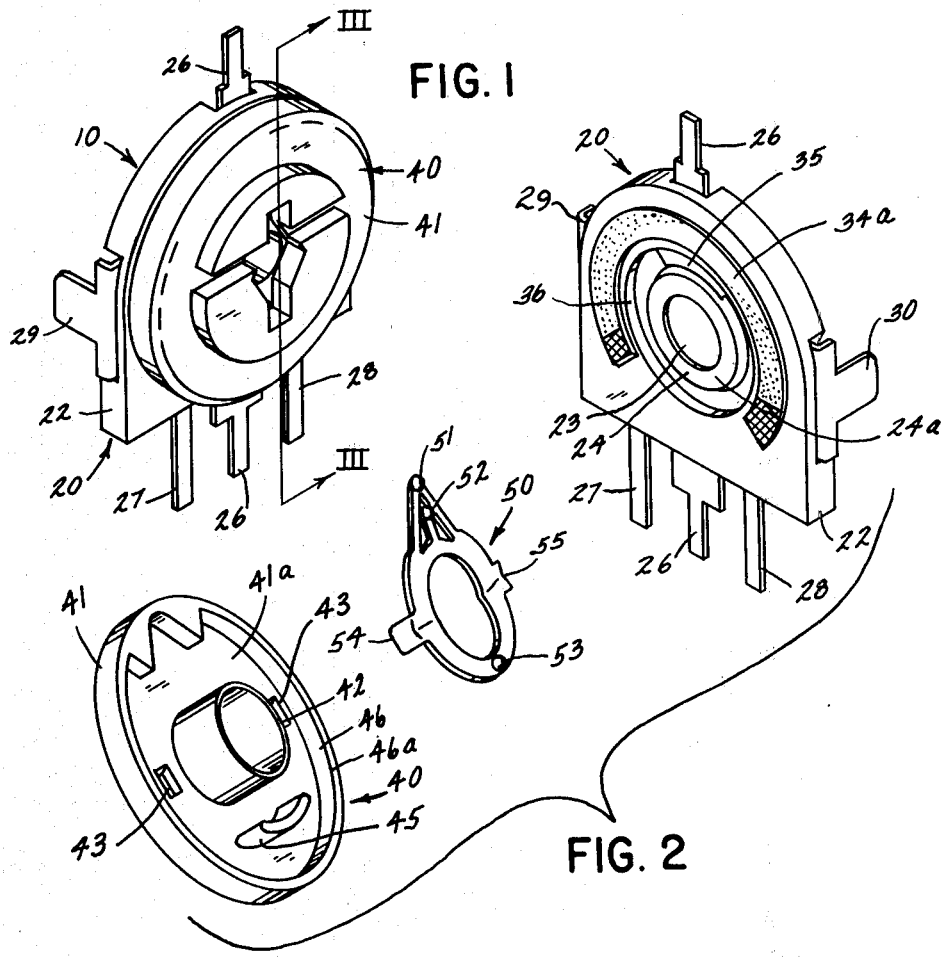
FIG. 1
FIG. 2
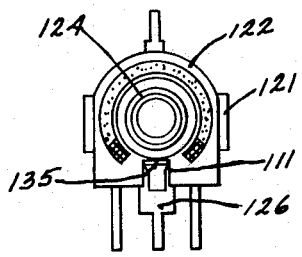
FIG. 6
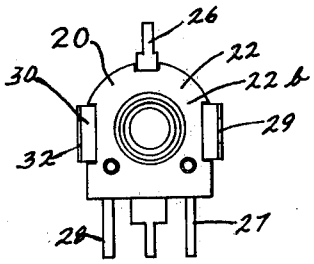
FIG. 5

METHOD OF MAKING A VARIABLE RESISTANCE CONTROL

This is a division of application Ser. No. 899,116 filed Apr. 24, 1978 and issued on July 1, 1980 as U.S. Pat. No. 4,210,896.

BACKGROUND OF THE INVENTION

1. Field of the Invention

The present invention relates generally to a variable resistance control and more particularly, to a control having terminals and a collector embedded in a molded body.

2. Description of the Prior Art

The prior art includes De Bell, U.S. Pat. No. 2,606,985; Youngbeck et al., U.S. Pat. No. 2,974,299; Van Benthuysen et al., U.S. Pat. No. 3,375,478; Burcham et al., U.S. Pat. No. 3,629,780; De Rouen et al., U.S. Pat. No. 3,729,817; and Budd et al., U.S. Pat. No. 3,389,364, all of which are included in the description of the present invention by reference herein thereto.

De Bell relates to a variable resistance control and a method of making same in which three terminals are blanked in an integral piece, are molded into a body, and are electrically severed from each other after molding the body.

Youngbeck et al. describe a variable resistance control and a method of making same in which a set of metallic elements comprising three terminals for a first control are formed in one portion of a metallic strip, succeeding sets of metallic elements are formed at spaced intervals in the strip, a shaft provided with an annular shoulder defining a collector is secured by staking to the center terminal of each of the sets, and separate bodies are molded to each of the sets of metallic elements and shaft before severing the metallic elements from the strip. Youngbeck et al. also describe the use of a circumferential skirt on the driver to stabilize the driver by engagement with the front surface of the molded body.

Van Benthuysen et al. show the use of a structure plate including both an integral collector and a pair of mounting lugs.

Burcham et al. describe a variable resistance control having a pair of terminals molded into a body with a portion of the terminals being exposed to and flush with a surface of the body, and in which a resistance element is deposited both onto the surface of the body and onto the exposed portion of the terminal.

De Rouen et al. contributed to the art by disclosing a method of making a variable resistance control wherein a plurality of terminals are blanked in sets in a strip of metal, a plurality of contact fingers are formed on the terminals, a housing body for the control is molded to each of the sets, and the control is completely assembled before severing of the terminals and completed assembly from the strip.

Budd et al. describe a variable resistance control having a molded base with a plurality of terminals embedded in the base and a resistance element secured to the base.

The present invention advances the art by providing a variable resistance control and method of making the same in which a body having front and rear surfaces in parallel relationship is molded around a structure plate formed from a strip of sheet metal that provides a collector ring, a heat sink, mounting lugs, terminals, and, a stop lug for the driver. A resistance element disposed on the front surface of the body in spaced coaxial relationship to the structure plate also corresponds in size and location to the structure plate.

SUMMARY OF THE INVENTION

In accord with the broader aspects of the present invention, there is provided a variable resistance control of the rotary type including a structure plate having front and back plate surfaces and having an aperture therethrough, a collector comprising a portion of the structure plate disposed radially outward of the aperture and including a collector surface comprising a portion of the front plate surface, a body molded to the structure plate and having a front body surface including an opening therein exposing the aperture and the collector surface, a center terminal comprising a portion of the structure plate extending outwardly from the body, a pair of resistance terminals molded into the body and having internal ends exposed on the front body surface and flush thereto, a resistance element arcuately deposited onto the front body surface radially outward from the collector surface and onto the internal ends of the resistance terminals, a driver having a hub rotatably journalled in the aperture of the structure plate for rotation about an axis coaxial with and orthogonal to the arcuately deposited resistance element and having an inner surface that is proximal to the front body surface, a contactor disposed intermediate the structure plate and the inner surface of the driver and electrically contacting both the collector surface and selected portions of the resistance element, and a heat sink comprising a portion of the structure plate substantially corresponding in size and coaxially of the resistance element.

In one embodiment of the present invention, an upwardly bent stop tab portion integral with the structural plate extends above the front surface of the molded body and above the resistance element to provide a stop lug for rotationally stopping the driver.

In the embodiment in which the variable resistance control includes the use of the tab portion for a rotation stop, the method includes bending the tab portion upwardly subsequent to depositing of the resistance element onto the surface of the molded body.

An object of the present invention is to provide an improved variable resistance control having a higher wattage dissipation than similar prior art variable resistance controls.

Another object of the present invention is to provide a variable resistance control with a heat sink proximal to an arcuately disposed resistance element and generally corresponding in size and location to the resistance element.

A further object of the present invention is to provide a variable resistance control with a structure plate having a shaft journalling aperture, a collector ring, a heat sink, terminals, and optionally, mounting lugs, all being integrally formed into a strip of sheet metal.

Still another object of the present invention is to achieve additional miniaturization of rotary variable resistance controls by utilizing an upwardly bent tab portion of the structure plate intermediate of the terminals to serve as a stop lug for rotationally stopping the driver and to a method of bending tab of such control.

Still a further object of the present invention is to provide a method of molding the body of a variable resistance control to a plurality of metal components of the resistance control while the metal parts are still attached to a strip.

Still a further object of the present invention is to provide a variable resistance control having a resistance element deposited onto a surface of a molded body in electrical contact with exposed surfaces of a pair of terminals.

Yet another object of the present invention is to provide a method for making a variable resistance control in which a stop lug, for limiting rotational movement of the driver, is bent up after the body is molded, and after the resistance element is deposited onto the molded body.

An additional object of the present invention is to provide a method for making a variable resistance control in which a body is molded to stationary metallic parts integrally secured to a strip and in which all other parts are assembled to the body before the completed control is severed from the remainder of the strip.

Further objects and advantages of the present invention will become apparent as the following description proceeds and the features of novelty characterizing the invention will be pointed out with particularity in the claims annexed to and forming a part of this specification.

BRIEF DESCRIPTION OF THE DRAWINGS

For a better understanding of the present invention, reference may be had to the accompanying drawings and detailed description wherein the same reference numbers have been applied to like parts:

FIG. 1 is an isometric view of a variable resistance control built in accord with the present invention;

FIG. 2 is an exploded view of the variable resistance control of FIG. 1;

FIG. 5 is a rear plan view of the body assembly of the variable resistance control shown in the third frame of FIG. 4; and FIG. 6 is a front plan view of another embodiment of a variable resistance control.

DETAILED DESCRIPTION OF THE DRAWINGS

Figure 3:
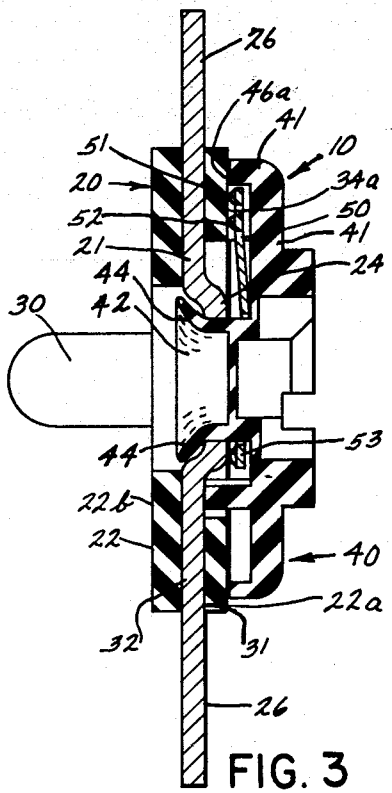
FIG. 3 is an enlarged cross-sectional view of the variable resistance control, taken along lines III—III of FIG. 1.

Referring now to the drawings, and more particularly to FIGS. 1–3, a variable resistance control generally depicted at 10 comprises a body assembly 20, a driver 40, and a contactor 50.

Figure 4:
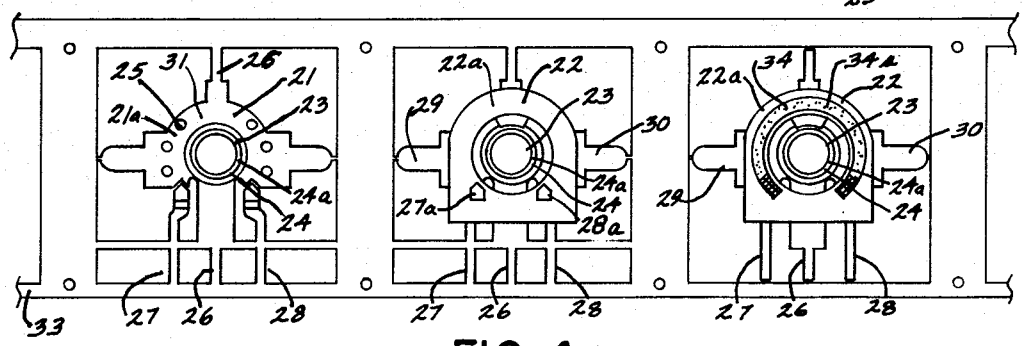
FIG. 4 is a plan view of a metal strip showing steps in the method of making the variable resistance control of FIG. 1.

Referring now specifically to FIG. 4, the body assembly 20 includes a structure plate 21 and a molded body 22. The structure plate 21 is provided with an aperture 23, a collector 24 defining a collector surface 24*a*, a plurality of tie holes 25, as best shown in frame 1 of FIG. 4, a center terminal 26, first and second resistance terminals 27, 28, and a pair of mounting lugs 29, 30. The structure plate 21 also includes a front plate surface 31 and a back plate surface 32. The body 22 is molded onto and around the plate surfaces 31, 32 and includes a front body surface 22*a* proximal to and substantially parallel to the front plate surface 31, and a rear body surface 22*b* proximal to and substantially parallel to the back plate surface.

The resistance terminals 27, 28 each contain an exposed inner end 27*a*, 28*a* (see FIG. 4) joggled upwardly and exposing surfaced portions to the front body surface 22*a* and being substantially flush therewith. Referring now to FIG. 4, after the body 22 is molded to the structure plate 21, an arcuately shaped resistance film 34 is deposited over the front body surface 22*a* and directly onto the exposed surfaces of the inner ends 27*a*, 28*a* of the terminals 27 and 28. The film 34 is then cured by heat to produce a resistance element 34*a* supported by and bonded to the front body surface 22*a* and also electrically connected at the inner ends 27*a*, 28*a* to the terminals. The inner ends 27*a*, 28*a* of the terminals 27, 28 are severed from the structure plate 21 so that when the body assembly 20 is severed from a strip or coil 33, the terminals 27, 28 are, except for the resistance element 34*a*, electrically isolated from each other and from the structure plate. The strip or coil 33 is a flat elongated piece of sheet metal.

The driver 40 as best shown in FIG. 1–3 includes a flange 41 having an inner surface 41*a* and a hub 42 extending orthogonally outward from the inner surface and rotatably supported in the aperture 23. The driver 40 thus rotates about an axis substantially concentric with the aperture 23 and substantially orthogonal to the front body surface 22*a*. The driver is preferably molded of thermplastic and the hub 42 is preferably heat deformed during assembly as shown at 44 to retain the hub 42 in the aperture.

As best seen in FIGS. 2 and 3, the contactor 50 includes contacts 51, 52 wipably engaging the arcuately shaped resistance element 34*a* and a contact 53 wipably engaging the collector surface 24*a*. The contactor 50 constrained to rotate with the driver 40 by means of the drive lugs 54, 55 engaging respective ones of a pair of slots 43 in the driver 40. In operation, the driver rotationally positions the contactor in electrical communication with the collector and the arcuately shaped resistance element 34*a*. Rotational movement of the driver is limited by abutting engagement of a stop lug 35 integral with the body 22 and an abutment 45 of the driver 40.

FIG. 6 depicts a body assembly 120 of a control similar to the control shown in FIGS. 1–5 of the drawings except a stop lug 135 is integrally formed with a structure plate 121, specifically from a center terminal 126 since the center portion of a body 122 is contiguous to a collector 124. The collector 24 of the variable resistance control 10 (see FIG. 2) is spaced from and provides an arcuate groove 36 for receiving the abutment 45 of the driver 40.

Referring now to the method of making the variable resistance control 10, the preferred method includes shearing and forming the structure plate 21 which includes the collector 24 and the mounting lugs 29, 30, the center terminal 26, and the resistance terminals 27, 28 as depicted in frame 1 of FIG. 4, molding the body 22 over such parts as depicted in frame 2 of FIG. 4, depositing by screening or other means well known in the art, a resistance film 34 onto the front body surface 22*a* and onto the exposed inner ends 27*a*, 28*a* of the terminals 27, 28 as depicted in frame 3 of FIG. 4, and curing the film to produce the resistance element 34*a*. The contactor 50 is then positioned over the hub 42 with the lugs 54, 55 received in the slots 43, of the driver 40, the driver 40 is assembled to the body assembly 20, and the hub 42 is heat swaged as shown at 44 of FIG. 3 prior to severing the finished control from the strip 33. In addition, depending on the customer application, the method includes bending the mounting lugs 29, 30 and terminals 26, 27 and 28 subsequent or prior to severing the body assembly 20 from the strip 33.

It should be understood that the strip 33 is first blanked and formed as shown in frame 1 of FIG. 4, the strip 33 is then taken successively: to a plastic molding machine where the body 22 is molded over each of the structure plates as shown in frame 2 of FIG. 4, to another machine where a resistance film 34 is deposited onto each of the bodies as shown in frame 3 of FIG. 4 and then cured, to the punch press for further forming and trimming operations, to an assembly machine for final assembly of the driver 40 and contactor 50 to the body assembly 20, and to a punch press for forming the lugs and terminals and severing the completely assembled resistance control 10 from the strip 33. When the stop lug 135 is formed from the center terminal 126, an additional forming operation is made to upend or bend the lug 135 upwardly when the mounting lugs are upended downwardly.

Referring now to FIG. 2, as to the differences in and advantages of the different embodiments, in the first preferred embodiment, the molded stop lug 35 cooperates with the molded abutment 45 of the driver 40 to limit rotary movement of the driver 40, the abutment 45 moving freely in the arcuate groove 36 in the body 22 of the body assembly 20 until the abutment 45 engages the stop lug 35. In such embodiment, the groove 36 is located radially intermediate of the collector surface 24*a* and the arcuately shaped resistance element 34*a*. Thus it can be seen that the embodiment of FIG. 6 in which the stop lug 135 projects upwardly from the front body surface eliminates the need for the arcuate groove and the space required for the groove.

Referring again to FIG. 2, the driver 40 includes a circumferential skirt 46 extending orthogonally outward from the inner surface 41*a* of the driver 40 and which is disposed radially outward from the resistance element 34*a*. Referring now to FIG. 6, the second preferred embodiment also receives the same driver 40. In both the first embodiment of FIG. 2 and the second embodiment of FIG. 6, each of the skirts operatively engages the front body surface to stabilize respective ones of the drivers, but in the first embodiment of FIG. 2, the entire face 46*a* of the skirt 46 engages a corresponding portion of the front body surface 22*a* whereas, in the second preferred embodiment of FIG. 6, a notch 111 in the body 122, which is provided for forming the stop lug 135 upwardly, presents a gap in the sealing between the face of the skirt and the surface of the body, thereby providing a limited space for the entrance of dirt or other contaminative particles.

Therefore, the first embodiment of FIG. 1 is preferred for moderately miniaturized variable resistance controls since the dirt exclusion properties of this embodiment are superior; and the second preferred embodiment of FIG. 6 is preferred where extreme miniaturization of a variable resistance control is a necessity.

The tie holes 25 (see frame 1 of FIG. 4) are included in the structure plate 21 so that the body 22 is tied to the plate surfaces 31, 32.

An important feature of the invention is that a large portion 21*a* of the structure plate 21 (see frame 1 of FIG. 4), lies radially between the collector and the peripheral edges of the structure plate 21, and which generally corresponds in size and location to the arcuately shaped resistance element 34*a* and serves as a heat sink substantially increasing the wattage capacity or heat dissipation of the variable resistance control 10. The width of the portion 21*a* of the structure plate 21 is substantially greater than the width of the collector 24, the collector having a width of approximately 0.050 inch and the portion 21*a* having a width of 0.125 inch which is more than twice that of the collector.

The heat sink includes not only the portion 21*a* of the structure plate 21, but other portions of the structure plate 21, and especially those portions of the structure plate 21 projecting from the body 22, such as the center terminal 26, the resistance terminals 27, 28 and the mounting lugs 29, 30.

Thus, maintaining the miniaturization in the first embodiment, or achieving a goal of subminiaturization in the second embodiment, does not result in a corresponding decrease in wattage capacity due to the heat sink functioning of the structure plate. Also, the molded construction of the body and the deposited layer construction of the resistance element, conduct heat across the boundaries of the various materials more efficiently than prior art constructions such as that of Van Benthuysen et al., U.S. Pat. No. 3,375,478, of common assignee.

While there have been illustrated and described what are at the present considered to be preferred embodiments of the present invention, and the preferred method for manufacturing thereof, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. A method for making a variable resistance control comprising the steps of:

(a) blanking terminals and a structure plate having a collector and stop means;

(b) molding a body onto the structure plate;

(c) depositing a resistance element onto a surface of the body and onto portions of the terminals; and (d) attaching a moveable contactor means in cooperative engagement with the resistance element to effect a variable resistance control.

2. The method of claim 1, including the additional step of:

(a) molding the body with front and rear surfaces in spaced parallel relationship with the structure plate spaced between the surfaces.

3. The method of claim 1 including the additional steps of:

(a) blanking the structure plate to have a pair of lugs, the lugs extending outwardly of the body; and (b) bending the lugs normal to the main plane of the structure plate.

4. In the process of making a variable resistor, the steps including:

(a) blanking a structure plate and a plurality of electrically spaced terminals, said structure plate including a collector and heat sink means;

(b) molding a body of electrically nonconductive material onto the structure plate;

(c) depositing a resistance element onto a surface of the body, the surface area of the heat sink means being substantially the same as or larger than the surface area of the resistance element.

5. The process of claim 4, including the additional steps of:

(a) forming the body during molding to expose that portion of the structure plate adjacent to the body defining the collector; and (b) securing a movable contactor to the structure plate and body with portions of the contactor wipably engaging the resistance element and the collector.

6. The method of claim 1, including the additional step of bending the stop means to extend outwardly beyond the resistance element.

7. The method of claim 4, including the step of forming the body during molding to include a stop means.

* * * * *